US006301940B1

(12) United States Patent
Derman et al.

(10) Patent No.: US 6,301,940 B1
(45) **Date of Patent: *Oct. 16, 2001**

(54) SECURITY HOLE FASTENING DEVICE

(75) Inventors: Jay S. Derman, Redondo Beach; Greg Zeren, Redwood City, both of CA (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/680,799

(22) Filed: Oct. 6, 2000

Related U.S. Application Data

(63) Continuation of application No. 09/128,049, filed on Aug. 3, 1998, now Pat. No. 6,173,591, which is a continuation-in-part of application No. 09/048,874, filed on Mar. 26, 1998, now Pat. No. 6,038,891, which is a continuation-in-part of application No. 08/825,213, filed on Mar. 27, 1997, now Pat. No. 5,787,739, which is a continuation-in-part of application No. 08/680,184, filed on Jul. 15, 1996, now abandoned.

(51) Int. Cl.[7] ..... E05B 69/00

(52) U.S. Cl. ..... 70/58; 70/18; 70/14; 70/158

(58) Field of Search ..... 70/14, 18, 58, 70/57, 63, 423, 424, 426, 428, 430, 158

(56) References Cited

U.S. PATENT DOCUMENTS

| | | | | |
|---|---|---|---|---|
| 505,299 | * | 9/1893 | Schneider . | |
| 934,928 | * | 9/1909 | Michel | 70/428 |
| 5,327,752 | * | 7/1994 | Myers et al. | 70/57 |
| 5,381,685 | * | 1/1995 | Carl et al. | 70/58 |
| 5,390,977 | * | 2/1995 | Miller . | |
| 5,493,878 | * | 2/1996 | Murray, Jr. et al. . | |
| 5,502,989 | * | 4/1996 | Murray, Jr. et al. . | |
| 5,687,592 | * | 11/1997 | Penniman et al. | 70/14 |
| 5,722,268 | * | 3/1998 | Choi | 70/57 |
| 5,787,739 | * | 8/1998 | Derman | 70/58 |
| 5,791,171 | * | 8/1998 | Kelley | 70/58 |
| 6,173,591 | * | 1/2001 | Derman | 70/58 |

FOREIGN PATENT DOCUMENTS

| | | | |
|---|---|---|---|
| 454901 | * | 3/1949 | (CA) . |
| 456219 | * | 2/1928 | (DE) . |
| 455740 | * | 3/1913 | (FR) . |
| 1085107 | * | 1/1995 | (FR) . |
| 447091 | * | 5/1936 | (GB) . |
| 14095 | * | 5/1905 | (NO) . |

* cited by examiner

*Primary Examiner*—Teri Pham Luu
(74) *Attorney, Agent, or Firm*—McCutchen, Doyle, Brown & Enersen, LLP

(57) ABSTRACT

A device for fastening to equipment subject to theft and having an outer shell provided with a security slot. The device is inserted in the security slot located in the shell of the equipment. The device includes two similarly-shaped, mirror-imaged insert members having a hooked tang protruding therefrom. The tangs are inserted through the security slot so that the hooks grip the inside surface of the equipment shell proximate the security slot, and the insert members are mated in juxtaposition. The insert members further include a cylindrical portion, that, when juxtaposed, creates a channel through which a cable or padlock may be passed to hold the insert members together. The device may include a sleeve to slidably cover the insert members.

15 Claims, 3 Drawing Sheets

SECURITY HOLE FASTENING DEVICE

CROSS-REFERENCES TO RELATED APPLICATIONS

This is a continuation application of U.S. patent application Ser. No. 09/128,049, filed Aug. 3, 1998, now U.S. Pat. No. 6,173,591, which is a continuation-in-part of application Ser. No. 09/048,874 filed Mar. 26, 1998, now U.S. Pat. No. 6,038,891, which is a continuation-in-part of application Ser. No. 08/825,213 filed Mar. 27, 1997, now U.S. Pat. No. 5,787,739, which is a continuation-in-part of application Ser. No. 08/680,184 filed Jul. 15, 1996 which is now abandoned, all of which are incorporated herein by reference for all purposes.

BACKGROUND OF THE INVENTION

The present invention relates to preventing theft of electronic equipment. More particularly, the present invention provides a device and method by which equipment is fastened to a locking mechanism.

There presently exists a number of devices and methods for preventing theft of equipment such as portable laptop computers and hand-held electronic devices. Typically, these methods include a fastening block which is either adhered to or screwed to an equipment's outer shell or casing. A wire cable or metal chain is then attached to the fastening block and the ends of the cable or chain are looped around a suitable immovable object and locked in place. This prevents the equipment from being removed by unauthorized persons. U.S. Pat. No. 5,351,507 of Jay S. Derman entitled "Wire Cable Locking Device" describes one such approach which is found to be successful.

In order to standardize the available methods of fastening securing devices to equipment, industry has incorporated security holes or slots in the outer shell of certain equipments. Conventional security slots are either rectangular or rounded in shape. A rounded hole that is circular permits a fastener to rotate in the hole 360 degrees, which could be advantageous for some equipment and easier to construct. Most security slots also incorporate the inside surface of the equipments' outer shell, to which a device could engage in a locking mode.

It is intended that the securing method utilize a fastener that can be inserted in the security slot provided in the equipment and thereby secure the equipment to a cable or padlock.

For the user's convenience, and for that of the equipment manufacturer, the fastener device should be able to stay attached to the equipment once it is inserted in the security hole, and not require an externally applied means such as a lock or cable to hold it in place. Loose fasteners may easily fall out of equipment security holes during attachment of a group of equipments to a cable, causing unnecessary bother. The same thing may occur when one or more equipments are removed from a securing cable for any reason, such as during a sale. It is, therefore, highly desirable to have a security hole fastener that will stay in place once inserted, and will take particular effort to be removed.

There are presently many known fasteners used for fastening to a piece of equipment, such as a door. Most of these fasteners use swivelling or pivoting arms that must be held in place by an external lock. These fasteners suffer from being susceptible to loosening and possibly falling out of the equipment security hole because of their size and construction. Further, none are adapted specifically for use with modern portable electronic equipment bearing standardized security slots.

It is therefore an object of the present invention to provide an inexpensive and reliable fastening device to prevent theft of portable equipment. It is a further object of the present invention to utilize a design which economizes the materials used in construction of the device, but which provides a high threshold of security. An even further object is to provide a device that, once fastened to an equipment shell, may not be pulled out or loosened.

SUMMARY OF THE INVENTION

The present invention provides a device for fastening to an equipment subject to theft and provided with a security slot in its outer shell. One embodiment of the present invention provides two insert members having a channel-defining portion with an outer end and an inner end, and a hooked tang having a distal end, an attachment end, and a bend therebetween. The attachment end is coupled to and projects from the channel-defining portion proximate said inner end. The hooked tang is adapted for insertion into the security slot such that the distal end bears against an inside surface of the shell. Juxtaposing the insert members in a locking mode provides for the distal ends to extend oppositely to secure the device to the equipment shell, and defines a channel wherein an object inserted into the channel retains the insert members in the locking mode.

In a second embodiment of the present invention, there is provided two insert members, each having a cylindrical portion, an outer end and an inner end. Each insert member has a hooked tang with a distal end, an attachment end coupled to and projecting from the cylindrical portion proximate said inner end, and a bend therebetween. The hooked tangs are adapted for insertion into the security slot such that their distal ends bear against an inside surface of the shell. By juxtaposing the inner ends of the insert members in a locking mode, the distal ends will extend oppositely to secure the device to the equipment shell.

In a third embodiment of the present invention, there is provided two insert members as above, and a sleeve, sized to slidably fit around the channel-defining portion of the insert members when in the locking mode. Association of the sleeve around the channel-defining portion of the insert members maintains the members in the locking mode.

A further understanding of the nature and advantages of the present invention may be realized by reference to the latter portions of the specification and attached drawings

DESCRIPTION OF THE SPECIFIC EMBODIMENTS

Figure 1:
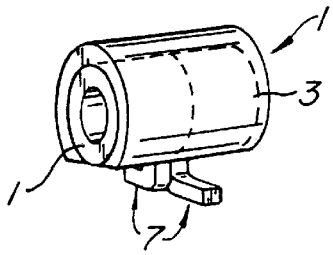
FIG. 1 is a perspective view of a preferred embodiment of an assembled fastening device.

Referring particularly to the drawings, there is shown in FIG. 1 a perspective view of a first embodiment of an assembled device according to the present invention. The device consists of two similar insert members 1 covered by a sleeve 3. Protruding out beneath both the insert members 1 and the sleeve 3 are hooked tangs 7 of the insert members 1.

Figure 2:
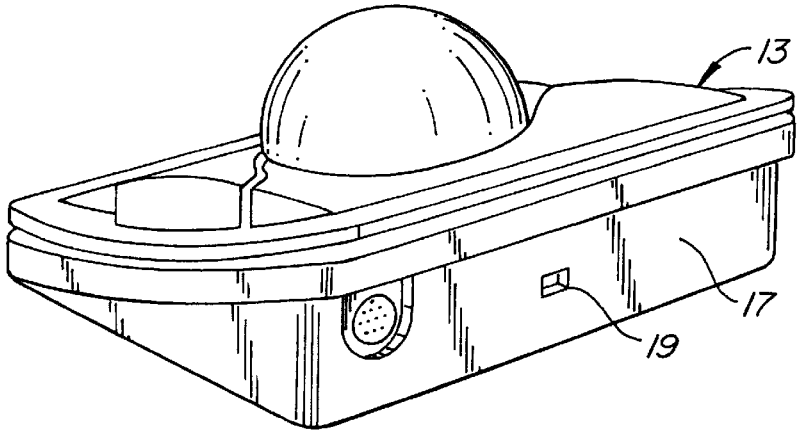
FIG. 2 is perspective view of an example equipment, particularly showing its shell defining a security slot.

Refer now to FIG. 2 which illustrates a typical computer equipment accessory 13, having a security slot 19 in its shell 17. Equipment 13 is shown as a computer peripheral device for example purposes only and should not limit the scope of the claims herein. One of ordinary skill in the art would recognize other modifications, variations and alternatives. For example, it should be apparent that any equipment subject to theft, such as a portable computer, a desktop computer, printer, scanner, or keyboard or the like, may be provided with a security slot for use with the present invention. Furthermore, security slots may be found in any portable equipment, such as skis, bikes, stereo equipment, etc.

Security slot 19 is shown as rectangular. As will be discussed below, several alternative embodiments dictate that the shape of security slot 19 should have a length longer than its width. However, in the preferred embodiment and variants thereof, the security slot 19 may be any suitable shape and size. For example, the slot may be square, rounded, or even circular, and its size need only accommodate hooked tangs 7 or similar locking elements. Therefore, the slot shown for illustration purposes in FIG. 2 should not limit the scope of the claims herein.

When the tang of each insert member 1 is properly inserted into a security slot 19, the hooked portion of each tang will bear against the inside surface of the equipment shell 17 around the slot 19. Placing the sleeve 3 over the insert members 1 juxtaposes the members in a side-to-side manner, with the tang 7 hook portions pointed outwardly and oppositely as shown in FIG. 1. This produces an even grip on the inside surface of the equipment shell 17.

As shown in FIG. 1, the sleeve 3 is sized to slidably fit over the insert members 1 and hold them together. The sleeve 3 may also fit over the insert members 1 in a loose manner, whereby the sleeve merely inhibits the insert members from moving apart axially. The insert members 1 themselves define an aperture or channel to accommodate an object such as a cable or padlock device. The use of a cable is illustrated in FIG. 3 which is a partial view of a computer accessory equipment 13, showing a portion of an object 21, such as a cable, passed through the preferred embodiment of the fastening device having a sleeve 3 and two insert members 1.

Figure 3:
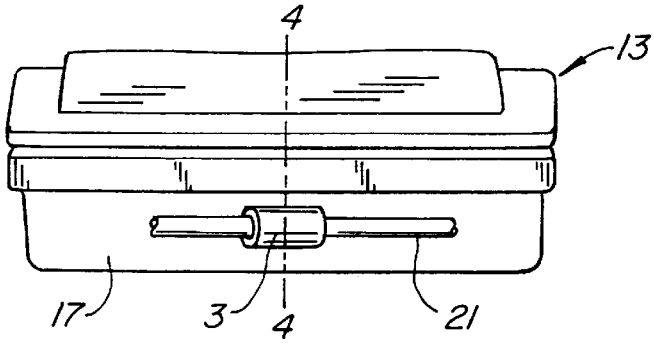
FIG. 3 is a partial rear view of an equipment, showing the invention fastening device installed in a security slot and a cable attached passing through the fastening device.
Figure 4A:
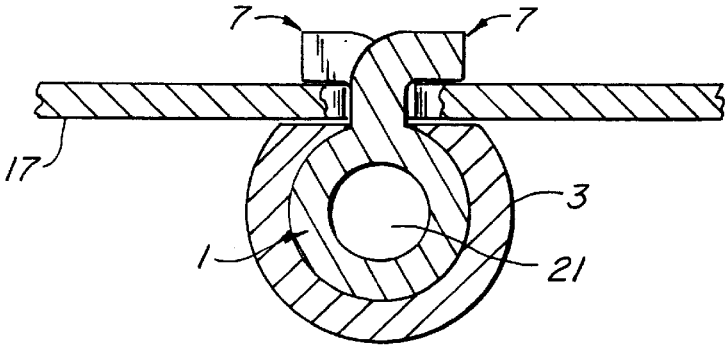
FIG. 4*a* is a sectional, partial side view of the shell of an equipment taken along line 4—4 of FIG. 3, particularly showing a first embodiment installed in a security slot with a cable attachment.

Refer now to FIG. 4*a* which is a partial cross-section view of an equipment shell 17 and the fastening device of the preferred embodiment inserted in a security slot taken along line 4—4 of FIG. 3. As can be seen, the tangs 7 of the insert members 1 are inserted through the security slot in the equipment shell 17, with the distal hooked ends of the tangs 7 extending oppositely. The insert members 1 define a cylindrical channel wherein an object 21 such as cable may pass.

The underside of the bent part, or distal end, of each tang 7 now bears against the inside surface of the equipment shell 17, and is held in that position by the sleeve 3. The sleeve 3 may have a open, planar bottom edge, which may bear against or near the outside surface of the shell 17. Thus, the insert members 1 of the device are held tightly in a security slot and cannot accidentally loosen.

Placing a object 21 such as a cable or a padlock arm through a channel in the fastening device, defined by a cylindrical portion of the insert members 1, adds one more level of securing the fastening device to the equipment outer shell. Insertion of the object 21 makes it virtually impossible to remove or loosen the device from its fastened or locked position. To loosen the device, the insert members 1 can be carefully separated and removed from the security slot only after first removing the sleeve 3.

Figure 4B:
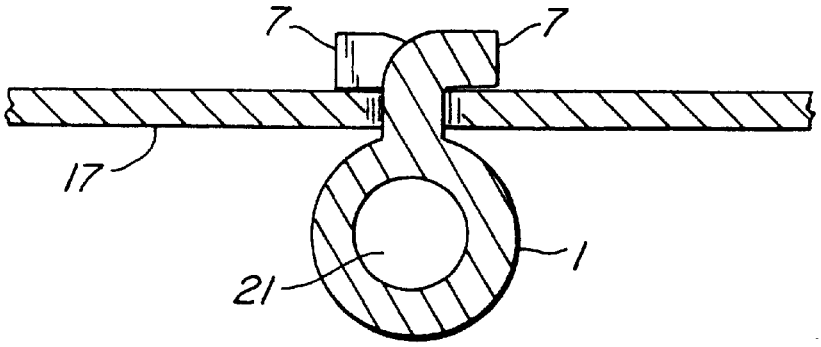
FIG. 4*b* is a sectional, partial side view of the shell of an equipment taken along line 4—4 of FIG. 3, particularly showing a second embodiment installed in a security slot with a cable attachment.

Refer now to FIG. 4*b* which is a partial cross-section view of an equipment shell 17 and the fastening device of a second embodiment inserted in a security slot taken along line 4—4 of FIG. 3. Shown are the insert members 1 with tangs 7 inserted into and bearing against the inside surface of equipment shell 17, as described above. In the second embodiment, simply placing an object 21 such as a cable or padlock through the insert member's 1 channel secures the fastening device to the equipment outer shell 17. The cable or padlock used must be sufficiently large in diameter to inhibit too large an axial movement of the individual insert members 1, so as to prevent the tangs 7 from being removed from the shell 17.

Figure 4C:
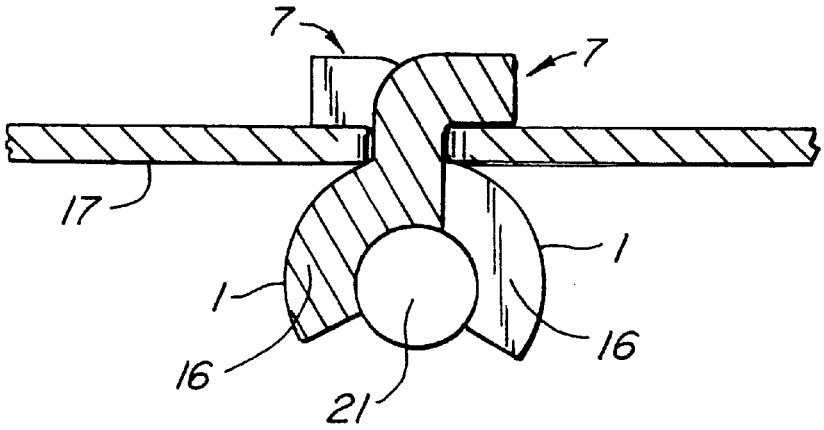
FIG. 4*c* is a sectional, partial side view of the shell of an equipment taken along line 4—4 of FIG. 3, particularly showing a third embodiment installed in a security slot with an object attachment.

FIG. 4*c* is a partial cross-section view of an equipment shell 17 and the fastening device of a third embodiment inserted in a security slot taken along line 4—4 of FIG. 3. Shown are the insert members 1 with tangs 7 inserted into and bearing against the inside surface of equipment shell 17, as described above. When juxtaposed in a locking mode, the two insert members 1 have a channel-defining portion 16 which define a channel through which an object 21 may be passed to secure the insert members 1 in the locking mode. As long as the channel is sufficiently concave, and the object 21 is sufficiently sized to fit into the channel, the insert members 1 will not release from the locking mode.

Figure 5:
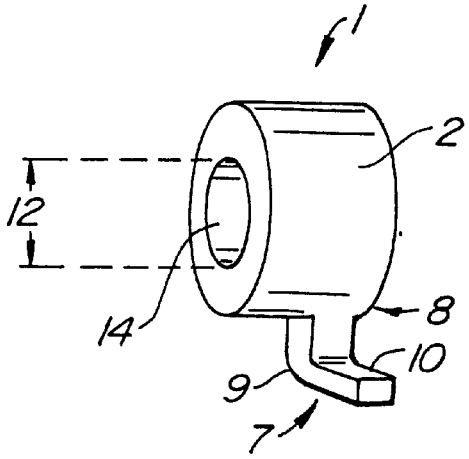
FIG. 5 is a perspective view of one insert member.
Figure 6:
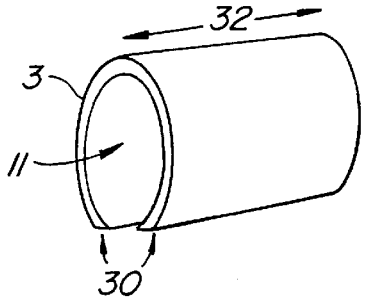
FIG. 6 is a perspective view of a sleeve which fits over two insert members.

Refer now to FIGS. 5 and 6 which show detail of an insert member 1 and a sleeve 3, respectively. Each insert member 1 may be made of metal or any rigid material that resists bending or breaking. Insert member 1 is formed in two basic portions, a cylindrical portion 2 and tang 7. The cylindrical portion 2 has an inner end 5 for mating to or adjoining a second insert member 1 in mirrored juxtaposition. In the preferred embodiment, the cylindrical portion defines substantially a cylindrical channel 14. In alternative embodiments, however, the channel may be multiangular. Further, the length of the channel may vary. The channel 14 has a diameter 12 to accommodate a cable or padlock.

The other portion of insert member 1 is a hooked tang 7. Tang 7 has an attachment end 8 where it is attached to an outer surface of the cylindrical portion 2 of the insert member 1, preferably proximate to inner end 5 of the cylindrical portion. Thus, when two insert members 1 are joined in juxtaposition, each members 1 hooked tang will preferably also be joined. The combined width of the two hooked tangs 7 should be substantially equal to the width of the security slot 19, with clearances.

When the hooked tangs 7 are inserted into the security slot, the cylindrical portion 2 prevents any other part of the insert members 1 from entering the slot. Tang 7 extends outwardly from cylindrical portion 2. The distance from attachment end 8 to a bend 9 may be substantially equal to the estimated depth of the equipment shell 17, as shown in FIG. 4. When the insert member is inserted into the slot, distal end 10 bears against the inside surface of shell 17. Distal end 10 extends from bend 9 at approximately 90 degrees from the plane of attachment end 8.

Referring now to FIG. 6, a sleeve 3 is shown. The sleeve 3 has a length 32 sized to slidably cover both insert members 1 when juxtaposed in the locking mode. The sleeve is made of a single sheet of material, formed into a concave semicircle. Preferably, sleeve 3 is formed to an almost complete cylinder shape. The sleeve 3 has terminal edges 30, which are preferably planar to bear against the surface of the equipment outer shell when the sleeve 3 is slid over insert members 1.

Figure 7:
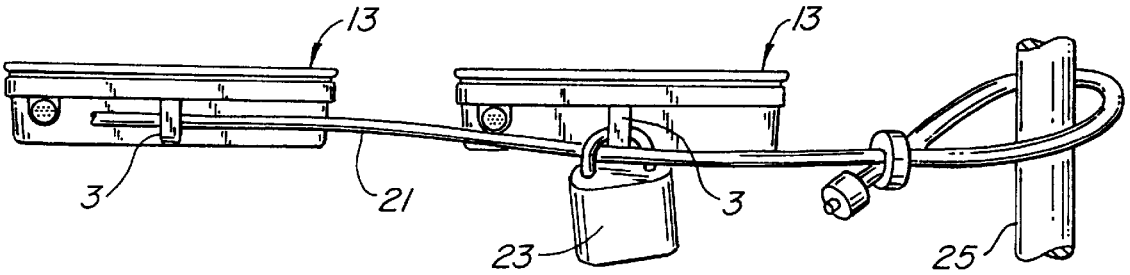
FIG. 7 is a view illustrating two or more equipments with security slots locked to a cable by the present invention.

Illustrated in FIG. 7 is one accepted application where the device of the present invention may be used together with a security slot in equipment to secure the equipment against theft. In the illustration, a computer accessory equipment 13 is secured to a cable 21 by having the cable 21 pass directly through a channel in the insert members 1 when their tangs are inserted in its security slot. An additional level of security is provided by sliding sleeve 3 over the insert members 1. This approach could be used where the several different equipments of a system are being secured together on one cable as would be the case in an office. The other equipment 13 has a padlock 23 arm going through the slots in its attached fastening device and the cable 21 passing through the padlock 23. This approach may be used wherever several equipments are located, yet desirable to be able to unlock and remove any one of the equipments separately.

As an example of how the equipment may be secured by a cable 21, the cable is shown having one end passed through a collar, looped around an immovable pole 25 with its end passing back through the collar and a clamp is locked on the end. The other end of the cable (not shown) would have a similar locked clamp attached to prevent pull through.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. A fastening system, comprising:

a portable electronic device having a wall defining a security slot;

two insert members, each said insert member comprising:

a channel-defining portion having an outer end and an inner end; and a tang having a distal end, an attachment end, and a connecting element therebetween, said attachment end coupled to and projecting from said channel-defining portion proximate said inner end; and wherein mating and aligning said inner ends of said insert members in a locking mode juxtaposes said tangs and provides for said distal ends to extend oppositely to secure said device to said equipment shell, and defines a channel wherein an object inserted into said channel retains said insert members in said locking mode.

2. The fastening system of claim 1 wherein said channel defines a channel axis and said tang is adapted for insertion into the security slot such that said distal end extends in a direction perpendicular to said channel axis and bears against an inside surface of the shell.

3. The fastening system of claim 1 wherein said channel defines a channel axis and said tang is adapted for insertion into the security slot such that said distal end extends in a direction parallel to said channel axis and bears against an inside surface of the shell.

4. The fastening system of claim 1 wherein said channel defining portions of said insert members extend perpendicular from said wall.

5. The system of claim 4 wherein said insert members are insertable independent from each other.

6. The fastening system of claim 1 wherein said security slot includes a length greater than said width with said length defining a length axis, and wherein said channel defines a channel axis, and wherein said channel axis is parallel to said length axis when said insert members are in said locking mode.

7. The fastening system of claim 1 wherein said security slot includes a length greater than said width with said length defining a length axis, and wherein said channel defines a channel axis, and wherein said channel axis is perpendicular to said length axis when said insert members are in said locking mode.

8. The fastening system of claim 1 wherein said channel-defining portion is cylindrical.

9. The system of claim 1 wherein said channel is defined by a discrete number of sides wherein said discrete number of sides includes three or more.

10. The system of claim 1 wherein said insert members are independent from each other.

11. A fastening device, comprising:

a portable electronic device having a wall defining a security slot;

two insert members, each said insert member comprising:

a cylindrical portion having an outer end and an inner end; and a tang having a distal end, an attachment end, and a connecting element therebetween, said attachment end coupled to and projecting from said cylindrical portion proximate said inner end, said tang adapted for insertion into said security slot such that said distal end bears against an inside surface of the shell; and wherein juxtaposing said inner ends of said insert members in a locking mode provides for said distal ends to extend oppositely to secure said device to said equipment shell.

12. The device of claim 11 further comprising an object inserted through said cylindrical portions to retain said insert members in said locking mode.

13. The device of claim 12 wherein said object is a cable.

14. The device of claim 11 wherein said cylindrical portion inner end is planar.

15. A device fastening method, comprising the steps of:

inserting a first insert member and a second insert member into a security slot defined in a wall of a portable device, each said insert member comprising a channel-defining portion having an outer end and an inner end, and a tang having a distal end, an attachment end, and a connecting element therebetween, said attachment end coupled to and projecting from said channel-defining portion proximate said inner end, said tang adapted for insertion into the security slot such that said distal end bears against an inside surface of the shell;

mating said insert members in a locking mode to juxtapose said tangs and enable said distal ends to extend oppositely to secure said insert members to said equipment shell and to define a channel; and inserting an object into said channel to retain said insert members in said locking mode.

* * * * *